US006583186B2

(12) United States Patent
Moore, Jr.

(10) Patent No.: US 6,583,186 B2
(45) Date of Patent: Jun. 24, 2003

(54) METHOD FOR UPGRADING FISCHER-TROPSCH WAX USING SPLIT-FEED HYDROCRACKING/HYDROTREATING

(75) Inventor: Richard O. Moore, Jr., San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 112 days.

(21) Appl. No.: 09/826,533

(22) Filed: Apr. 4, 2001

(65) Prior Publication Data

US 2002/0144929 A1 Oct. 10, 2002

(51) Int. Cl.[7] ..... C07C 27/00; C07C 1/00; C10G 71/00; C10G 35/04; C10G 47/00

(52) U.S. Cl. ..... 518/700; 585/302; 585/314; 208/18; 208/64; 208/111; 208/212; 208/133

(58) Field of Search ..... 518/700; 208/950, 208/64, 18, 111, 212, 133; 585/302, 314

(56) References Cited

U.S. PATENT DOCUMENTS

| | | | |
|---|---|---|---|
| 3,248,316 | A | 4/1966 | Barger, Jr. et al. |
| 3,617,498 | A | 11/1971 | Kittrell |
| 4,092,238 | A | 5/1978 | Iona |
| 4,173,529 | A | 11/1979 | Bauer |
| 4,211,635 | A | 7/1980 | Chen |
| 4,615,796 | A | 10/1986 | Kramer |
| 4,851,109 | A | 7/1989 | Chen et al. |
| 5,378,348 | A | 1/1995 | Davis et al. |
| 5,409,599 | A | 4/1995 | Harandi |
| 5,603,824 | A | 2/1997 | Kyan et al. |
| 5,690,896 | A | 11/1997 | Stangeland et al. |
| 5,770,044 | A | 6/1998 | Ellis et al. |
| 5,837,208 | A | 11/1998 | Grott et al. |
| 5,851,381 | A | 12/1998 | Tanaka et al. |
| 6,096,190 | A | 8/2000 | Cash |
| 6,103,101 | A | 8/2000 | Fragelli et al. |
| 6,179,995 | B1 | 1/2001 | Cash et al. |
| 6,200,462 | B1 | 3/2001 | Cash et al. |
| 6,210,559 | B1 | 4/2001 | Cook et al. |
| 6,224,747 | B1 | 5/2001 | Cash et al. |
| 6,274,029 | B1 | 8/2001 | Wittenbrink et al. |
| 6,296,757 | B1 | 10/2001 | Wittenbrink et al. |
| 6,299,759 | B1 | 10/2001 | Bradway et al. |

FOREIGN PATENT DOCUMENTS

| | | |
|---|---|---|
| DE | 214 859 | 10/1984 |
| EP | 0 321 305 | 6/1989 |
| EP | 609 079 | 7/1998 |
| EP | 921 184 | 6/1999 |
| WO | WO 97/03750 | 2/1997 |
| WO | WO 99/41329 | 8/1999 |
| WO | WO 99/47626 | 9/1999 |
| WO | WO 00/20535 | 4/2000 |
| WO | WO 01/57158 | 8/2001 |

OTHER PUBLICATIONS

U.S. Patent Application 09/227,783 entitled "Hydrocracking and Hydrotreating Separate Refinery Streams", Cash and Dahlberg, filed Jan. 8, 1999.

*Primary Examiner*—J. Parsa
(74) *Attorney, Agent, or Firm*—Burns, Doane, Swecker & Mathis, L.L.P.

(57) ABSTRACT

The present invention is directed to a method for hydroprocessing Fischer-Tropsch products. The invention in particular relates to an integrated method for producing liquid fuels from a hydrocarbon stream provided by Fischer-Tropsch synthesis. The method involves separating the Fischer-Tropsch products into a light fraction and a heavy fraction. The heavy fraction is subjected to hydrocracking conditions, preferably through multiple catalyst beds, to reduce the chain length. The products of the hydrocracking reaction following the last catalyst bed, optionally after a hydroisomerization step, are combined with the light fraction. The combined fractions are hydrotreated, and, optionally, hydroisomerized. The hydrotreatment conditions hydrogenate double bonds, reduce oxygenates to paraffins, and desulfurize and denitrify the products. Hydroisomerization converts at least a portion of the linear paraffins into isoparaffins.

17 Claims, 1 Drawing Sheet

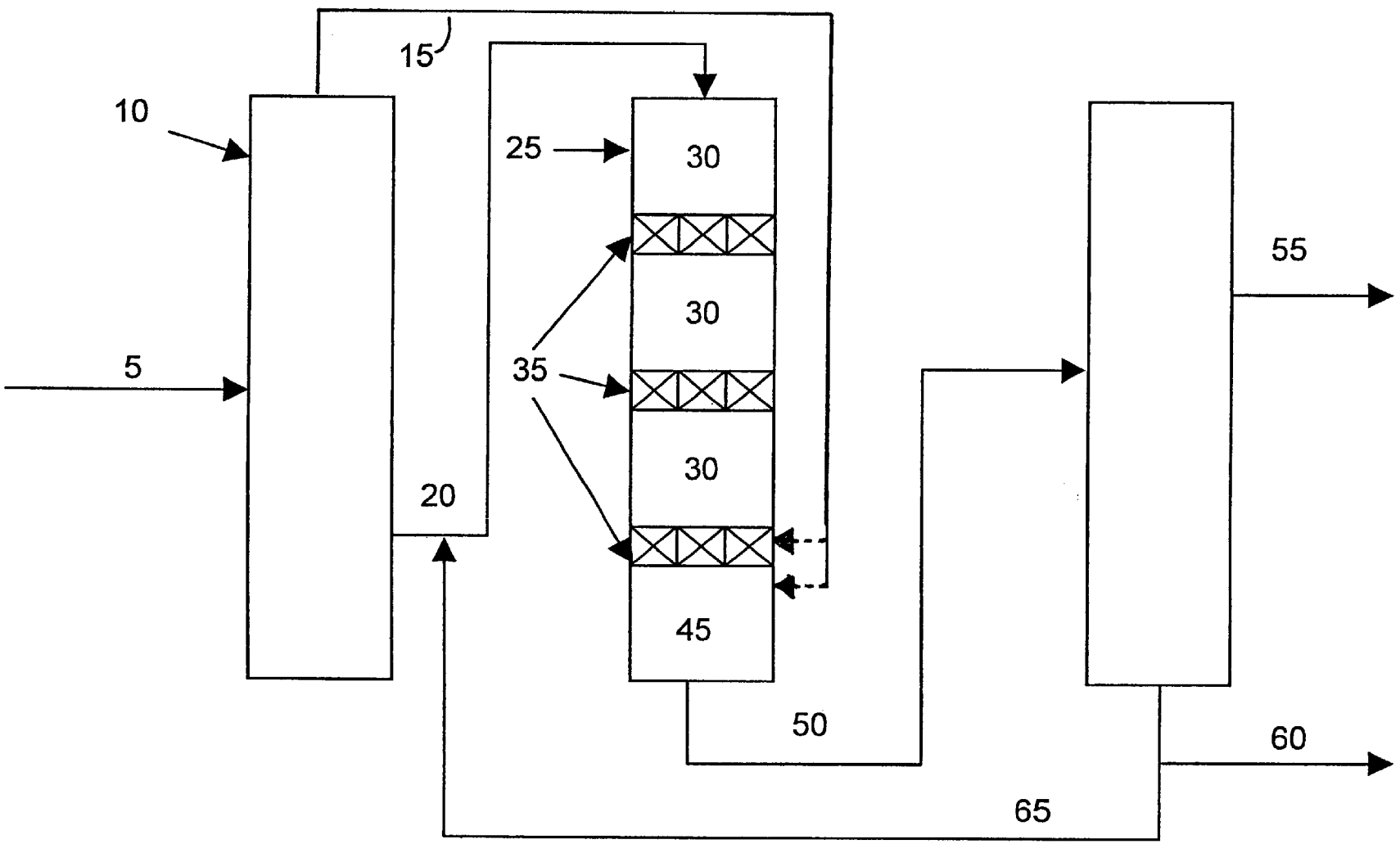
FIGURE

METHOD FOR UPGRADING FISCHER-TROPSCH WAX USING SPLIT-FEED HYDROCRACKING/HYDROTREATING

BACKGROUND OF THE INVENTION

The majority of combustible liquid fuel used in the world today is derived from crude oil. However, there are several limitations to using crude oil as a fuel source. For example, crude oil is in limited supply, it includes aromatic compounds believed to cause cancer, and contains sulfur and nitrogen-containing compounds that can adversely affect the environment.

Alternative sources for developing combustible liquid fuel are desirable. An abundant source is natural gas. The conversion of natural gas to combustible liquid fuel typically involves converting the natural gas, which is mostly methane, to synthesis gas, or syngas, which is a mixture of carbon monoxide and hydrogen. An advantage of using fuels prepared from syngas is that they typically do not contain appreciable amounts of nitrogen and sulfur and generally do not contain aromatic compounds. Accordingly, they have less health and environmental impact than conventional petroleum-based fuels. Fischer-Tropsch synthesis is a preferred means for converting syngas to higher molecular weight hydrocarbon products.

Fischer-Tropsch synthesis is often performed under conditions which produce a large quantity of $C_{20}$+wax, which must be hydroprocessed to provide distillate fuels. Often, the wax is hydrocracked to reduce the chain length, and then hydrotreated to reduce oxygenates and olefins to paraffins. Although some catalysts have been developed with selectivity for longer chain hydrocarbons, the hydrocracking tends to reduce the chain length of all of the hydrocarbons in the feed. When the feed includes hydrocarbons that are already in a desired range, for example, the distillate fuel range, hydrocracking of these hydrocarbons is undesirable.

It would be advantageous to provide a method for hydroprocessing Fischer-Tropsch wax which minimizes the hydrocracking of hydrocarbons in the distillate fuel range. The present invention provides such methods.

SUMMARY OF THE INVENTION

The present invention is directed to a method for hydroprocessing Fischer-Tropsch products. The invention in particular relates to an integrated method for producing liquid fuels from a hydrocarbon stream provided by Fischer-Tropsch synthesis. The method involves separating the Fischer-Tropsch products into a light fraction with normal boiling points below 700° F. and including predominantly $C_{5-20}$ components and a heavy fraction with normal boiling points above 650° F. and including predominantly $C_{20}$+ components. The heavy fraction is subjected to hydrocracking conditions, preferably through multiple catalyst beds, to reduce the chain length. The products of the hydrocracking reaction following the last hydrocracking catalyst bed, optionally after a hydroisomerization step, are combined with all or a portion of the light fraction. The combined fractions are hydrotreated, and, optionally, hydroisomerized. Hydrotreatment hydrogenates double bonds, reduces oxygenates to paraffins and desulfurizes and denitrifies the fractions. Hydroisomerization converts at least a portion of the linear paraffins into isoparaffins.

When the products of the hydrocracking reaction have passed through the last bed of hydrocracking catalyst, they are at a relatively elevated temperature. When these products are combined with the light fraction, the light fraction acts as a quench fluid, cooling the fraction, preferably to a desired temperature for performing the hydrotreatment step.

In one embodiment, the light fraction is introduced into a reactor at a level below the last hydrocracking catalyst bed and above or within a hydrotreatment bed. In this embodiment, the temperature and/or pressure of the hydrotreatment bed can be, and preferably are essentially the same as that in the hydrocracking bed(s). In another embodiment, the products from the hydrocracking reactor are pumped to a separate hydrotreatment reactor, where they are combined with the light fraction. In this embodiment, the temperature and or pressure of the hydrotreatment reactor can be, and preferably are different than that in the hydrocracking reactor.

The products from this "split-feed" hydroprocessing reaction can be separated into at least a hydrogen-rich gas stream, a distillate product predominantly in the $C_{5-20}$ range, and a bottoms stream. The bottoms stream can optionally be resubjected to the hydrocracking conditions to provide an additional light fraction, or used, for example, to prepare a lube base stock.

In one embodiment, the heavy fraction and/or the light fraction include hydrocarbons in the same range derived from other sources, for example, petroleum refining.

BRIEF DESCRIPTION OF THE DRAWING

The FIGURE is an illustrative schematic flow diagram representing one preferred embodiment of the invention, but the invention is. applicable to all appropriate refineries and/or chemical processes.

DETAILED DESCRIPTION OF THE INVENTION

The present invention is directed to a method for hydroprocessing Fischer-Tropsch products. The invention in particular relates to an integrated method for producing liquid fuels from a hydrocarbon stream provided by Fischer-Tropsch synthesis, which in turn involves the initial conversion of a light hydrocarbon stream to syngas and conversion of the syngas to higher molecular weight hydrocarbon products.

The method involves separating the Fischer-Tropsch products into a light fraction and a heavy fraction (or, alternatively, obtaining such fractions from an appropriate source). The heavy-fraction is subjected to hydrocracking conditions, through one or more catalyst beds, to reduce the chain length. The products of the hydrocracking, optionally after a hydroisomerization step, are combined with the light fraction. The combined fractions are hydrotreated, and, optionally, hydroisomerized.

The methods are advantageous for many reasons. The light fraction quenches the high temperature hydrocracking products. The hydrocracking of the light fraction is minimized, relative to the case where the entire $C_5$+fraction from a Fischer-Tropsch synthesis is subjected to similar hydrocracking conditions. The isolation of products in the desired $C_{5-20}$ range, for example, mid-distillates, can be enhanced by minimizing the hydrocracking of Fischer-Tropsch products in the $C_{5-20}$ range. Further, by removing the light fraction from the feed to the hydrocracking reactor, the throughput of heavy hydrocarbons to the reactor is increased. The methods allow for heat exchange between the relatively high temperature hydrocracking products and the relatively cool light fraction. This heat exchange can be used to bring the temperature of the light fraction up to the desired hydrotreatment temperature, and also to cool the hydrocracking products down to the desired hydrotreatment temperature.

In one aspect, the methods reduce the number of reactor vessels required for hydroprocessing in a refinery. The methods also permit hydroprocessing of two product streams using a single hydrogen supply and a single hydrogen recovery system. The methods can also extend the life of the hydrocracking catalyst by minimizing contact of the light fraction with the hydrocracking catalysts.

Definitions

Light hydrocarbon feedstock: These feedstocks can include methane, ethane, propane, butane and mixtures thereof. In addition, carbon dioxide, carbon monoxide, ethylene, propylene and butenes may be present.

A light fraction is a fraction in which at least 75% by weight, more preferably 85% by weight, and most preferably, at least 90% by weight of the components have a boiling point in the range of between 50 and 700° F. and which includes predominantly components having carbon numbers in the range of 5 to 20, i.e. $C_{5-20}$. A heavy fraction is a fraction in which at least 80% by weight, more preferably 85% by weight, and most preferably, at least 90% by weight of the components have a boiling point higher than 650° F. and which includes predominantly $C_{20}$+components. In a preferred embodiment, the heavy fraction includes at least 80% by weight of paraffins and, more preferably, no more than about 1% by weight of oxygenates. In a separate preferred embodiment, the light fraction includes at least 0.1% by weight of oxygenates.

A 650° F.+containing product stream is a product stream that includes greater than 75% by weight 650° F.+material, preferably greater than 85% by weight 650° F.+material, and, most preferably, greater than 90% by weight 650° F.+material as determined by ASTM D2887 or other suitable methods. The 650° F.−containing product stream is similarly defined.

Paraffin: A hydrocarbon with the formula $C_nH_{2n+2}$.

Olefin. A hydrocarbon with at least one carbon-carbon double bond.

Oxygenate: A hydrocarbonaceous compound that includes at least one oxygen atom.

Distillate fuel: A material containing hydrocarbons with boiling points between about 60° and 800° F. The term "distillate" means that typical fuels of this type can be generated from vapor overhead streams from distilling petroleum crude. In contrast, residual fuels cannot be generated from vapor overhead streams by distilling petroleum crude, and are then a non-vaporizable remaining portion. Within the broad category of distillate fuels are specific fuels that include: naphtha, jet fuel, diesel fuel, kerosene, aviation gas, fuel oil, and blends thereof.

Diesel fuel: A material suitable for use in diesel engines and conforming to one of the following specifications:

ASTM D 975—"Standard Specification for Diesel Fuel Oils"

European Grade CEN 90

Japanese Fuel Standards JIS K 2204

The United States National Conference on Weights and Measures (NCWM) 1997 guidelines for premium diesel fuel The United States Engine Manufacturers Association recommended guideline for premium diesel fuel (FQP-1A)

Jet fuel: A material suitable for use in turbine engines for aircraft or other uses meeting one of the following specifications:

ASTM D1655

DEF STAN 91-91/3 (DERD 2494), TURBINE FUEL, AVIATION, KEROSINE TYPE, JET A-1, NATO CODE: F-35.

International Air Transportation Association (IATA) Guidance Materials for Aviation, $4^{th}$ edition, March 2000.

Natural Gas

Natural gas is an example of a light hydrocarbon feedstock. In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. Natural gas fields also typically contain a significant amount of $C_5$+material, which is liquid at ambient conditions.

The methane, and optionally ethane and/or other hydrocarbons, can be isolated and used to generate syngas. Various other impurities can be readily separated. Inert impurities such as nitrogen and helium can be tolerated. The methane in the natural gas can be isolated, for example in a demethanizer, and then de-sulfurized and sent to a syngas generator.

Syngas

Methane (and/or ethane and heavier hydrocarbons) can be sent through a conventional syngas generator to provide synthesis gas. Typically, synthesis gas contains hydrogen and carbon monoxide, and may include minor amounts of carbon dioxide, water, unconverted light hydrocarbon feedstock and various other impurities. The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guard beds are preferred for removing sulfur impurities. Means for removing other contaminants are well known to those of skill in the art.

Fischer-Tropsch Synthesis

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300° to 700° F. (149 to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from $C_1$ to $C_{200}$+ with a majority in the $C_5$–$C_{100}$+range. The reaction can be conducted in a variety of reactor types for example, fixed bed reactors containing one or more catalyst beds, slurry reactors, fluidized bed reactors, or a combination of different type reactors.

Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, also completed incorporated herein by reference for all purposes.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

Product Isolation from Fischer-Tropsch Synthesis

The products from Fischer-Tropsch reactions performed in HT reactors are generally gaseous products that can form a liquid product when a portion of the gaseous product condenses. Depending on the particular conditions, these temperatures can vary significantly, for example, with the gaseous reaction product including products with boiling points up to about 700° F.

The products from Fischer-Tropsch reactions performed in slurry bed reactors generally include a light fraction (i.e. condensate fraction) and a heavy fraction (i.e. wax fraction). The light liquid reaction product includes hydrocarbons boiling below about 700° F. (e.g., tail gases through middle distillates, with increasingly smaller amounts of material up to about $C_{30}$), preferably in the range $C_5$-650° F. The waxy reaction product includes hydrocarbons boiling above about 600° F. (e.g., vacuum gas oil through heavy paraffins with increasingly smaller amounts of material down to about $C_{10}$).

When the gaseous reaction product from the Fischer-Tropsch synthesis step is being cooled and various fractions collected, the first fractions collected tend to have higher average molecular weights than subsequent fractions.

Additional Hydrocarbon Streams

The light and heavy fractions described above can optionally be combined with hydrocarbons from other streams, for example, streams from petroleum refining. The light fractions can be combined, for example, with similar fractions obtained from the fractional distillation of crude oil. The heavy fractions can be combined, for example, with waxy crude oils, crude oils and/or slack waxes from petroleum deoiling and dewaxing operations.

Optional Treatment of the Light Fraction Before Hydrotreatment

The light fraction typically includes a mixture of hydrocarbons, including mono-olefins and alcohols. The mono-olefins are typically present in an amount of at least about 5.0 wt % of the fraction. The alcohols are usually present in an amount typically of at least about 0.5 wt % or more.

The fraction can be transmitted via pipes to a position in the hydroprocessing reactor below the last hydrocracking bed and above or within the hydrotreatment beds at a temperature above about 40° C.

Prior to reaction, the pressurized fraction is preferably mixed with a hydrogen-containing gas stream. When the fraction is heated upon combination with the heated hydrocracking stream ("hydrocrackate"), the olefins may form heavy molecular weight products, such as polymers. Adding even a small amount (i.e., less than about 500 SCFB) of hydrogen-containing gas to the fraction before it is heated by the hydrocrackate prevents or minimizes formation of the undesirable heavier molecular weight products.

The source of hydrogen can be virtually any hydrogen-containing gas that does not include significant amounts of impurities that would adversely affect the hydrotreatment catalysts. In particular, the hydrogen-containing gas includes sufficient amounts of hydrogen to achieve the desired effect, and may include other gases that are not harmful to the formation of desired end products and that do not promote or accelerate fouling of the downstream catalysts and hydrotreatment equipment. Examples of possible hydrogen-containing gases include hydrogen gas and syngas. The hydrogen can be from a hydrogen plant, recycle gas in a hydroprocessing unit and the like. Alternately, the hydrogen-containing gas may be a portion of the hydrogen used for hydrocracking the heavy fraction.

After the hydrogen-containing gas is introduced into the fraction, the fraction can be pre-heated, if necessary, in a heat exchanger. The methods of heating the fractions in the heat exchangers can include any methods known to practitioners in the art. For example, a shell and tube heat exchanger may be used, wherein a heated substance, such as steam or a reaction product from elsewhere in the method, is fed through an outer shell, providing heat to the fraction in an inner tube, thus heating the fraction and cooling the heated substance in the shell. Alternately, the fraction may be heated directly by passing through a heated tube, wherein the heat may be supplied by electricity, combustion, or any other source known to practitioners in the art.

Hydroprocessing Reactors

Hydrocracking generally refers to breaking down the high molecular weight components of hydrocarbon feed to form other, lower molecular weight products. Hydrotreatment hydrogenates double bonds, reduces oxygenates to paraffins, and desulfurizes and denitrifies hydrocarbon feeds. Hydroisomerization converts at least a portion of the linear paraffins into isoparaffins.

In hydrocracking reactions, pressures and temperatures are often close to the limit the reactors can handle. Multiple catalyst beds with intermediate cooling stages are typically used to control the extremely exothermic hydrocracking reaction. Because the reactions are exothermic, the temperature of the reaction mixture increases and the catalyst beds heat up as the mixture passes through the beds and the reactions proceed. In order to limit the temperature rise and control the reaction rate, a quench fluid is introduced between the catalyst beds.

Ideally, there is less than a 100° F. temperature rise in each bed, preferably less than about 50° F. per bed, with cooling stages used to bring the temperature back to a manageable level. The heated effluent from each bed is mixed with the quench fluid in a suitable mixing device (sometimes referred to as an inter-bed redistributor or a mixer/distributor) to cool the effluent sufficiently so that it can be sent through the next catalyst bed.

Typically, hydrogen gas.is used as a quenching fluid. The hydrogen gas is typically introduced at around 150° F. or above, which is extremely cold relative to the reactant temperatures (typically between 650° and 750° F.). When multiple catalyst beds are used, hydrogen and/or other quench fluids can be used in the intermediate cooling stages. After the final hydrocracking bed, a quench with hydrogen gas is not required, since the light fraction is combined with the heated hydrocracking products, which then cools the hydrocracking products.

Reactor internals between the catalysts beds are designed to ensure both a thorough mixing of the reactants with the quench fluid and a good distribution of vapor and liquid flowing to the next catalyst bed. Good distribution of the reactants prevents hot spots and excessive naphtha and gas make, and maximizes catalyst life. This is particularly important where the heavy fraction includes an appreciable amount of olefins, which makes it highly reactive. Poor distribution and mixing can result in non-selective cracking of the wax to light gas. Examples of suitable mixing devices are described, for example, in U.S. Pat. No. 5,837,208, U.S. Pat. No. 5,690,896, U.S. Pat. No. 5,462,719 and U.S. Pat. No. 5,484,578, the contents of which are hereby incorporated by reference. A preferred mixing device is described in U.S. Pat. No. 5,690,896.

The reactor includes a means for introducing the light fraction below the last hydrocracking bed and above or within the first hydrotreating bed. Preferably, the fraction is introduced as a liquid rather than a gas, to better absorb heat from the heated hydrocrackate.

Preferably, the reactor is a downflow reactor that includes at least two catalyst beds, with inter-bed redistributors between the beds. The top bed(s) include a hydrocracking catalyst and, optionally, one or more beds include a dewaxing or hydroisomerization catalyst.

In a first embodiment, the reactor that includes beds of the hydrocracking catalyst(s) also includes a bottom bed or beds that include a hydrotreatment catalyst. In this embodiment, the temperature and or pressure at the hydrotreatment catalyst beds can be, and generally are the same as that in the hydrocracking reactor. In a second embodiment, a separate reactor contains a hydrotreatment catalyst, and the combined fractions are sent to the separate reactor. In this embodiment, the temperature and or pressure of the hydrotreatment reactor can be, and generally are different from that in the hydrocracking reactor.

In one embodiment, the products of the hydrocracking reaction can be removed between beds, with continuing reaction of the remaining stream in subsequent beds. U.S. Pat. No. 3,172,836 discloses a liquid/vapor separation zone located between two catalyst beds for withdrawing a gaseous fraction and a liquid fraction from a first catalyst bed. Such techniques can be used if desired to isolate products. However, since the products of the hydrocracking reaction are typically gaseous at the reaction temperature, the residence time of the gaseous products on the catalyst beds is sufficiently low, and further hydrocracking of the product would be expected to be minimal, so product isolation is not required.

The catalysts and conditions for performing hydrocracking, hydroisomerization and hydrotreating reactions are discussed in more detail below.

Hydrocracking

The heavy fractions described above can be hydrocracked using conditions well known to those of skill in the art. In a preferred embodiment, hydrocracking conditions involve passing a feed stream, such as the heavy fraction, through a plurality of hydrocracking catalyst beds under conditions of elevated temperature and/or pressure. The plurality of catalyst beds may function to remove impurities such as any metals and other solids which may be present, and/or to crack or convert the feedstock. Hydrocracking is a process of breaking longer carbon chain molecules into smaller ones. It can be effected by contacting the particular fraction or combination of fractions, with hydrogen in the presence of a suitable hydrocracking catalyst at hydrocracking conditions, including temperatures in the range of about from 600° to 900° F. (316° to 482° C.) preferably 650° to 850° F. (343 to 454° C.) and pressures in the range about from 200 to 4000 psia (13–272 atm) preferably 500 to 3000 psia (34–204 atm) using space velocities based on the hydrocarbon feedstock of about 0.1 to 10 $hr^{-1}$ preferably 0.25 to 5 $hr^{-1}$. In general, hydrocracking catalysts include a cracking component and a hydrogenation component on an oxide support material or binder. The cracking component may include an amorphous cracking component and/or a zeolite, such as a Y-type zeolite, an ultrastable Y-type zeolite or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC notation) elements and/or from the Group VI (IUPAC notation) elements are generally chosen. Group V elements include chromium, molybdenum and tungsten. Group VIII elements include iron, cobalt, nickel, ruthenium, rhodium, palladium, osmium, iridium, and platinum. The amount(s) of hydrogenation component(s) in the catalyst suitable range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulfidic form. If a combination of at least a Group Vi and a Group VIII metal component is present as (mixed) oxides, it will be subjected to a sulfiding treatment prior to proper use in hydrocracking. Suitably, the catalyst includes one or more components of nickel and/or cobalt and one or more components of molybdenum and/or tungsten and one or more components of platinum and/or palladium. Catalysts containing nickel and molybdenum, nickel and tungsten, platinum and/or palladium are particularly preferred.

The hydrocracking particles used herein may be prepared, for example, by blending or co-mulling active sources of hydrogenation metals with a binder. Examples of suitable binders include silica, alumina, clays, zirconia, titania, magnesia and silica-alumina. Preference is given to the use of alumina as a binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternatively, equally suitable methods for preparing the amorphous catalyst particles include preparing oxide binder particles, for example, by extrusion, drying and calcining, followed by depositing the hydrogenation metals on the oxide particles, using methods such as impregnation. The catalyst particles, containing the hydrogenation metals, are preferably then further dried and calcined before use as a hydrocracking catalyst.

Preferred catalyst systems include one or more of zeolite Y, zeolite ultrastable Y, SAPO-11, SAPO-31, SAPO-37, SAPO-41, ZSM-5, ZSM-11, ZSM-48, and SSZ-32.

Hydroisomerization

In one embodiment, the hydrocracked products and/or the light fraction are hydroisomerized to provide branching, thus lowering the pour point. Catalysts useful for isomerization processes are generally bifunctional catalysts that include a dehydrogenation/hydrogenation component, an acidic component. Preferably, the hydroisomerization catalysts used herein are not sulfur sensitive but instead are enhanced by the presence of sulfur.

The hydroisomerization catalyst(s) can be prepared using well known methods, e.g., impregnation with an aqueous salt, incipient wetness technique, followed by drying at about 125°–150° C. for 1–24 hours, calcination at about 300°–500° C. for about 1–6 hours, reduction by treatment with a hydrogen or a hydrogen-containing gas, and, if desired, sulfiding by treatment with a sulfur-containing gas, e.g., $H_2S$ at elevated temperatures. The catalyst will then have about 0.01 to 10 wt % sulfur. The metals can be composited or added to the catalyst either serially, in any order, or by co-impregnation of two or more metals. Additional details regarding preferred components of the hydroisomerization catalysts are described below.

Dehydrogenation/ Hydrogenation Component

The dehydrogenation/ hydrogenation component is preferably a Group VIII metal, more preferably a Group VIII non-noble metal, or a Group VI metal. Preferred metals include nickel, platinum, palladium, cobalt and mixtures thereof. The Group VIII metal is usually present in catalytically effective amounts, that is, ranging from 0.5 to 20 wt %. Preferably, a Group VI metal is incorporated into the catalyst, e.g., molybdenum, in amounts of about 1–20 wt %.

Acidic Component

Examples of suitable acid components include crystalline zeolites, catalyst supports such as halogenated alumina components or silica-alumina components, and amorphous metal oxides. Such paraffin isomerization catalysts are well known in the art. The acid component may be a catalyst support with which the catalytic metal or metals are composited. Preferably, the acidic component is a zeolite or a silica-alumina support.

Preferred supports include silica, alumina, silica-alumina, silica-alumina-phosphates, titania, zirconia, vanadia and other Group III, IV, V or VI oxides, as well as Y sieves, such as ultra stable Y sieves. Preferred supports include alumina and silica-alumina, more preferably silica-alumina where the silica concentration of the bulk support is less than about 50 wt %, preferably less than about 35 wt %, more preferably 15–30 wt %. When alumina is used as the support, small amounts of chlorine or fluorine may be incorporated into the support to provide the acid functionality.

A preferred supported catalyst has surface areas in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis, Volume VII, Ed. Paul H. Emmett, Reinhold Publishing Corporation, New York, (1960).

Preferred dewaxing/hydroisomerization catalysts include SAPO-11, SAPO-31, SAPO-41, SSZ-32 and/or ZSM-5.

Hydrotreatment

During hydrotreating, oxygen, and any sulfur and nitrogen present in the feed is reduced to low levels. Aromatics and olefins are also reduced. Hydrotreating catalysts and reaction conditions are selected to minimize cracking reactions, which reduce the yield of the most desulfided fuel product.

Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 hr.sup. −1 to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically such hydrotreating catalysts are presulfided.

The products from the hydrocracking of the heavy fractions described above are combined with at least a portion of the light fractions and the combined fractions subjected to hydrotreatment conditions.

In one embodiment, the light fraction is introduced into a reactor at a level below the last hydrocracking catalyst bed and above or within the hydrotreatment bed. In this embodiment, the temperature and or pressure of the hydrotreatment bed can be, and generally are the same as that in the hydrocracking bed(s). Redistributors are generally placed between catalyst beds, for redistributing the fluids passing from catalyst bed to catalyst bed, and the fluids added to the redistributor (e.g. a hydrogen containing gas or a liquid stream) from outside the reactor. Redistributors are well known in the art (e.g. U.S. Pat. No. 5,690,896). In another embodiment, the products from the hydrocracking reactor are pumped to a separate hydrotreatment reactor, where they are combined with the light fraction. In this embodiment, the temperature and or pressure of the hydrotreatment reactor can be, and preferably are different than that in the hydrocracking reactor.

Catalysts useful for hydrotreating the combined fractions are well known in the art. See, for example, U.S. Pat. Nos.

4,347,121 and 4,810,357 for general descriptions of hydrotreating catalysts and conditions. Suitable catalysts include noble metals from Group VIIIA, such as platinum or palladium on an alumina or siliceous matrix, and Group VIIIA and Group VIB metals, such as nickel-molybdenum or nickel-tin on an alumina or siliceous matrix. U.S. Pat. No. 3,852,207 describes suitable noble metal catalysts and mild hydrotreating conditions. Other suitable catalysts are described, for example, in U.S. Pat. Nos. 4,157,294 and 3,904,513. The contents of these patents are hereby incorporated by reference.

The non-noble (such as nickel-molybdenum) hydrogenation metal is usually present in the final catalyst composition as an oxide or, more preferably, as a sulfide, when such compounds are readily formed from the particular metal involved. Preferred non-noble metal catalyst compositions contain in excess of about 5 weight percent, preferably about 5 to about 40 weight percent, molybdenum and/or tungsten, and at least about 0.5, preferably about 1 to about 15 weight percent of nickel and/or cobalt determined as the corresponding oxides. The noble metal (such as platinum) catalyst contains in excess of about 0.01 percent metal, preferably between about 0.1 and about 1.0 percent metal. Combinations of noble metals may also be used, such as mixtures of platinum and palladium.

In a preferred embodiment, the hydrotreatment reactor includes a plurality of catalyst beds, wherein one or more beds may function to remove impurities such as any metals and other solids which may be present, one or more additional beds may function to crack or convert the feedstock, and one or more other beds may function to hydrotreat the oxygenates and olefins in the light and/or heavy fraction.

Method Steps

The heavy fraction is hydrocracked through the beds of the hydrocracking catalyst, with cooling between the beds. After the hydrocracking is complete, the effluent from the last hydrocracking bed is combined with the light fraction and the combined fractions subjected to hydrotreatment conditions. Preferably, the light fraction is a liquid, not a gas at the temperature at which it is combined with the effluent from the hydrocracking beds, so that the liquid adsorbs more heat from the heated effluent.

When the hydrotreatment catalyst is present in one or more beds beneath the beds of hydrocracking catalyst, the light fraction can be added above or within the bed. When the hydrotreatment catalyst is present in a separate reactor, the effluent from the last hydrocracking bed can be combined with the light fraction and then sent to the hydrotreatment reactor.

The products from the hydrotreatment reaction are preferably separated into at least two fractions, a light fraction and a bottoms fraction. The light fraction can be subject to distillation, catalytic isomerization and/or various additional method steps to provide gasoline, diesel fuel, jet fuel and the like, as known to practitioners in the art.

The bottoms fraction can optionally be recycled to the hydroprocessing reactors, to provide an additional light fraction. Alternatively, the fraction can be subject to distillation, catalytic isomerization, dewaxing and/or various additional method steps to provide lube base oil stocks, as known to practitioners in the art.

Preferred dewaxing catalysts include SAPO-11, SAPO-31, SAPO-41, SSZ-32, and ZSM-5. Alternatively, or in addition, the fraction can be subjected to solvent dewaxing conditions, as such are known in the art. Such conditions typically involve using solvents such as methylethyl ketone and toluene, where addition of such solvents or solvent mixtures at an appropriate temperature results in the precipitation of wax from the bottoms fraction. The precipitated wax can then be readily removed using means well known to those of skill in the art.

The method described herein will be readily understood by referring to the particularly preferred embodiment in the flow diagram in the accompanying FIGURE. In the FIGURE, a syngas feed (5) is sent to a Fischer-Tropsch synthesis process (10) and the products of a Fischer-Trospch synthesis are separated into at least a light (15) and a heavy (20) fraction. The heavy fraction is sent to a hydrocracking reactor (25) with a plurality of hydrocracking catalyst beds (30) supported on redistributors (35). After the fraction has passed through the last hydrocracking catalyst bed, it is combined with the light fraction (15), and passed through one or more hydrotreatment beds (45). The product of the hydrotreatment reaction (50) is split into various fractions, including a light fraction (55) and a bottoms (60) fraction. At least a portion of the bottoms fraction (60) may be recycled (65) to the hydrocracking reactor.

Those skilled in the art will recognize, or be able to ascertain using no more than routine experimentation, many equivalents to the specific embodiments of the invention described herein. Such equivalents are intended to be encompassed by the following claims.

What is claimed is:

1. A method for producing liquid fuels from a hydrocarbon stream comprising:

a) isolating a light fraction and a heavy fraction from a Fischer-Tropsch synthesis, b) subjecting the heavy fraction to hydrocracking conditions to form a heated effluent, c) combining the heated effluent with the light fraction, and d) hydrotreating the combined fractions.

2. The method of claim 1, wherein the hydrocracking conditions involve passing the heavy fraction through one or more hydrocracking catalyst beds under conditions of elevated temperature and/or pressure and passing the combined fraction through one or more hydrotreating catalyst beds under conditions of elevated temperature and/or pressure.

3. The method of claim 1, wherein the hydrotreatment is performed in one or more hydrotreatment catalyst beds within the same reactor as the hydrocracking catalyst beds, wherein the hydrotreatment catalyst beds are located below the hydrocracking catalyst beds.

4. The method of claim 1, wherein the hydrotreatment is performed in one or more catalyst beds in a different reactor than that which included the hydrocracking catalyst beds.

5. The method of claim 1, further comprising separating the products of the hydrotreatment step into at least a light fraction and a bottoms fraction.

6. The method of claim 5, further comprising recycling the bottoms fraction through the hydrocracking reactor.

7. The method of claim 5, further comprising using the bottoms fraction to prepare a lube oil base stock feed.

8. The method of claim 7, further comprising subjecting the bottoms fraction to dewaxing conditions to produce a product with a pour point lower than the pour point of the bottoms fraction.

9. The method of claim 8, wherein the bottoms fraction is dewaxed using a catalyst system comprising at least one molecular sieve selected from the group consisting of SAPO-11, SAPO-31 and SAPO-41.

10. The method of claim 8, wherein the bottoms fraction is dewaxed using a catalyst system comprising SSZ-32.

11. The method of claim 8, wherein the bottoms fraction is dewaxed using a catalyst system comprising ZSM-5.

12. The method of claim 1, wherein the hydrocracking catalyst system comprises a zeolite selected from the group consisting of zeolite Y and zeolite ultrastable Y.

13. The method of claim 1, wherein the hydrocracking catalyst system comprises a zeolite selected from the group consisting of SAPO-11, SAPO-31, SAPO-37 and SAPO-41.

14. The method of claim 1, wherein the hydrocracking catalyst system comprises a zeolite selected from the group consisting of ZSM-5, ZSM-11 and ZSM-48.

15. The method of claim 1, wherein the hydrocracking catalyst system comprises SSZ-32.

16. The method of claim 1, wherein the heavy fraction includes at least 80% by weight of paraffins and no more than about 1% by weight of oxygenates.

17. The method of claim 1, wherein the light fraction includes at least 0.1% by weight of oxygenates.

* * * * *